US005655728A

United States Patent [19]

Yang

[11] Patent Number: 5,655,728

[45] Date of Patent: Aug. 12, 1997

[54] WATER SPRAY HOSE ROLLING DEVICE

[75] Inventor: Ming-Shun Yang, Taipei, Taiwan

[73] Assignee: Formosa Saint Jose Corp., Taipei, Taiwan

[21] Appl. No.: 444,558

[22] Filed: May 19, 1995

[51] Int. Cl.[6] ..... B65H 75/40

[52] U.S. Cl. ..... 242/395.1; 242/396.5; 242/397.5; 242/402; 242/405.3; 242/407; 137/355.16

[58] Field of Search ..... 242/395, 395.1, 242/396.5, 396.6, 397.5, 402, 405, 405.3, 407; 137/355.16, 355.2, 355.23, 355.26, 355.27

[56] References Cited

U.S. PATENT DOCUMENTS

| | | | |
|---|---|---|---|
| 279,190 | 6/1883 | Sager | 242/396.9 |
| 1,915,632 | 6/1933 | Marks | 242/395 |
| 2,249,433 | 7/1941 | Palmer | 242/395 |
| 2,268,178 | 12/1941 | Boisture | 242/395.1 |
| 2,438,306 | 3/1948 | Souther | 242/395 |
| 2,856,470 | 10/1958 | Hyde | 242/395.1 |
| 3,295,787 | 1/1967 | Golonka | 242/396.5 |
| 3,471,885 | 10/1969 | McLoughlin et al. | 242/397.5 |
| 3,946,964 | 3/1976 | Zinser | 242/395 |
| 4,251,038 | 2/1981 | Gename | 242/397.5 |
| 4,306,688 | 12/1981 | Hechler | 242/397 |
| 5,421,533 | 6/1995 | Scott et al. | 242/405.3 |

*Primary Examiner*—John M. Jillions
*Attorney, Agent, or Firm*—Erik M Arnhem

[57] ABSTRACT

The present invention consists of a water spray hose device, a fixed base and a movable base, wherein the inner side plate of the fixed base is provided with a holder and a disk capable of continuously positioning, catching and stopping, and the outer side plate thereof is provided with a handle and a clip capable of fixing a spray connector; the inner side plate of movable base is provided with a brake element under the control of a spring; when the movable base is assembled with the fixed base, the stop on the brake element will intermittently move along the continuous corrugated chutes of the disk so as to control the action of stretching or folding the spray hose; and the outer side plate of the movable base is provided with a framed groove capable of disposing the inlet connector and a pair of recesses capable of folding the spray hose. Through the foregoing structure, the water spray hose of the present invention can be folded in the movable base and conveniently stretched out from the movable base for use.

4 Claims, 8 Drawing Sheets

WATER SPRAY HOSE ROLLING DEVICE

BACKGROUND OF THE INVENTION

When washing cars or watering flowers and trees outdoors, a water spray hose several feet can be used. However, after use thereof, this long hose is inevitably laid down on the ground topsyturvy; it is very troublesome to pick up and store such a long hose. Recently a flat folding water spray hose has become available. The volume of such a hose is considerably reduced but its length cannot be shortened. Therefore, it is very difficult and inconvenient to pick up and store such a long hose laid down on the ground topsyturvy. A water spray hose reeling device according to the present invention is designed to eliminate this drawback.

SUMMARY OF THE INVENTION

The present invention consists of a water spray hose device, a fixed base and a movable base, wherein the inner side plate of the fixed base is provided with a roller holder and a disk capable of continuously positioning, catching and stopping the movable base. The inner side plate of the movable base is provided with a brake element under the control of a spring; when the movable base is assembled with the fixed base, the stop on the brake element will intermittently move along the continuous corrugated chutes of the disk so as to control the action of stretching or folding the spray hose. The outer side plate of the movable base is provided with a compartment capable of disposing the inlet connector and a pair of recesses capable of folding the spray hose. Through the foregoing structure, the water spray hose of the present invention can be folded in the movable base and conveniently stretched out from the movable base for use.

DETAILED DESCRIPTION

Figure 1:
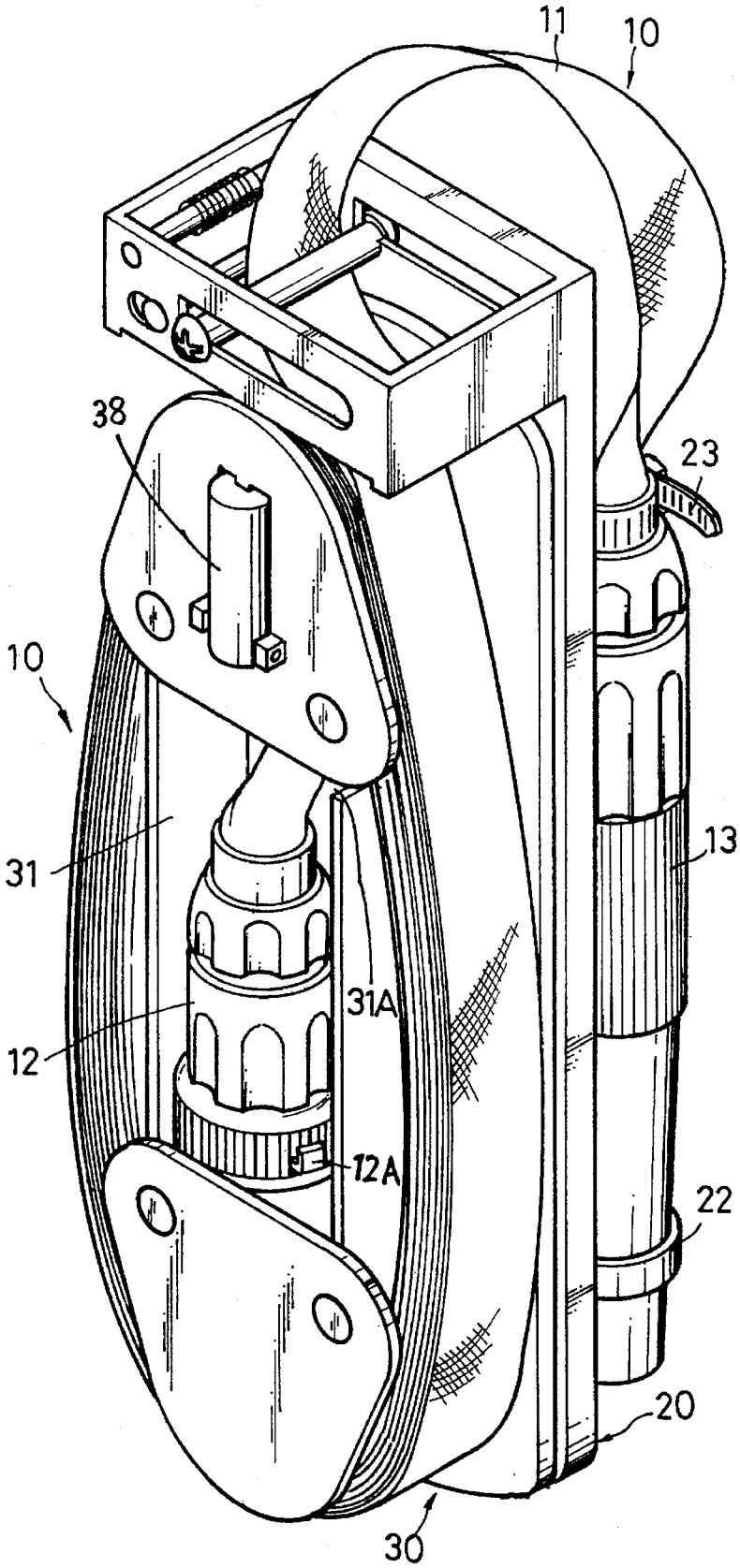
FIG. 1 is an appearance view of the water spray hose device stored in the movable base according to the present invention.
Figure 2:
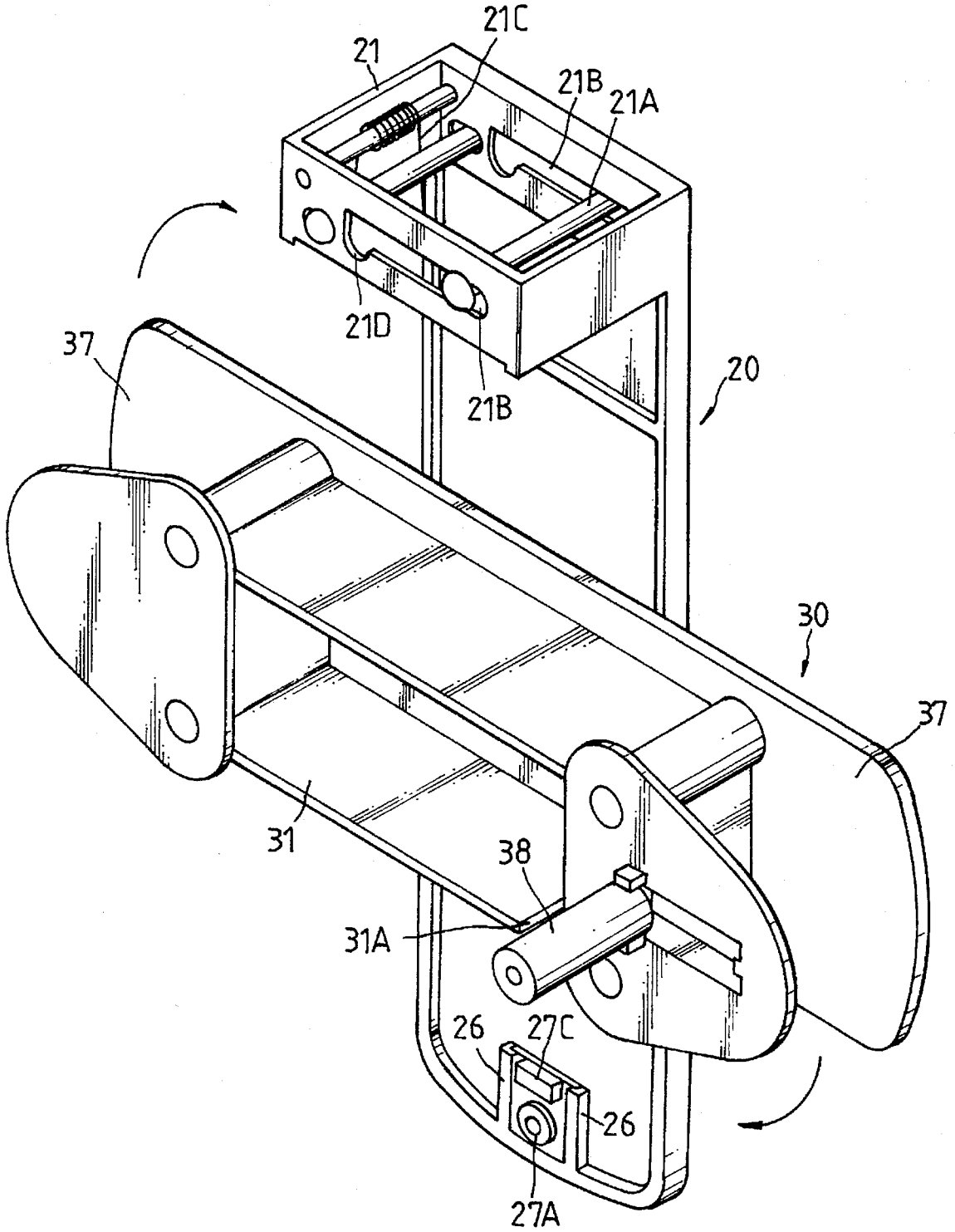
FIG. 2 is an elevational appearance view of fixed base and movable base of the present invention.

As shown in FIGS. 1 and 2, the present invention consists of a water spray hose device (10), a fixed base (20) and a movable base (30); wherein the water spray hose device (10) has a water spray hose (11) several feet long having is a flat folding spray hose having an inlet connector (12) at one open end of the hose (11) and a spray connector (13) at another open end thereof. When folding the water spray hose device, the inlet connector (12) is first inserted in a holder (21) on the fixed base (20) and then disposed and fixed in a compartment (31) on the outer side plate of movable base (30), then a folding handle of rocker (38) on the movable base (30) is turned to rotate the movable base (30) so as to entirely roll and store the water spray hose (11) in recesses (37) at the ends of the movable base (30). Finally the spray connector (13) is inserted in a clamp (22) on the outer side plate of the fixed base (20) and fixed thereon with a movable clip (23).

Figure 3:
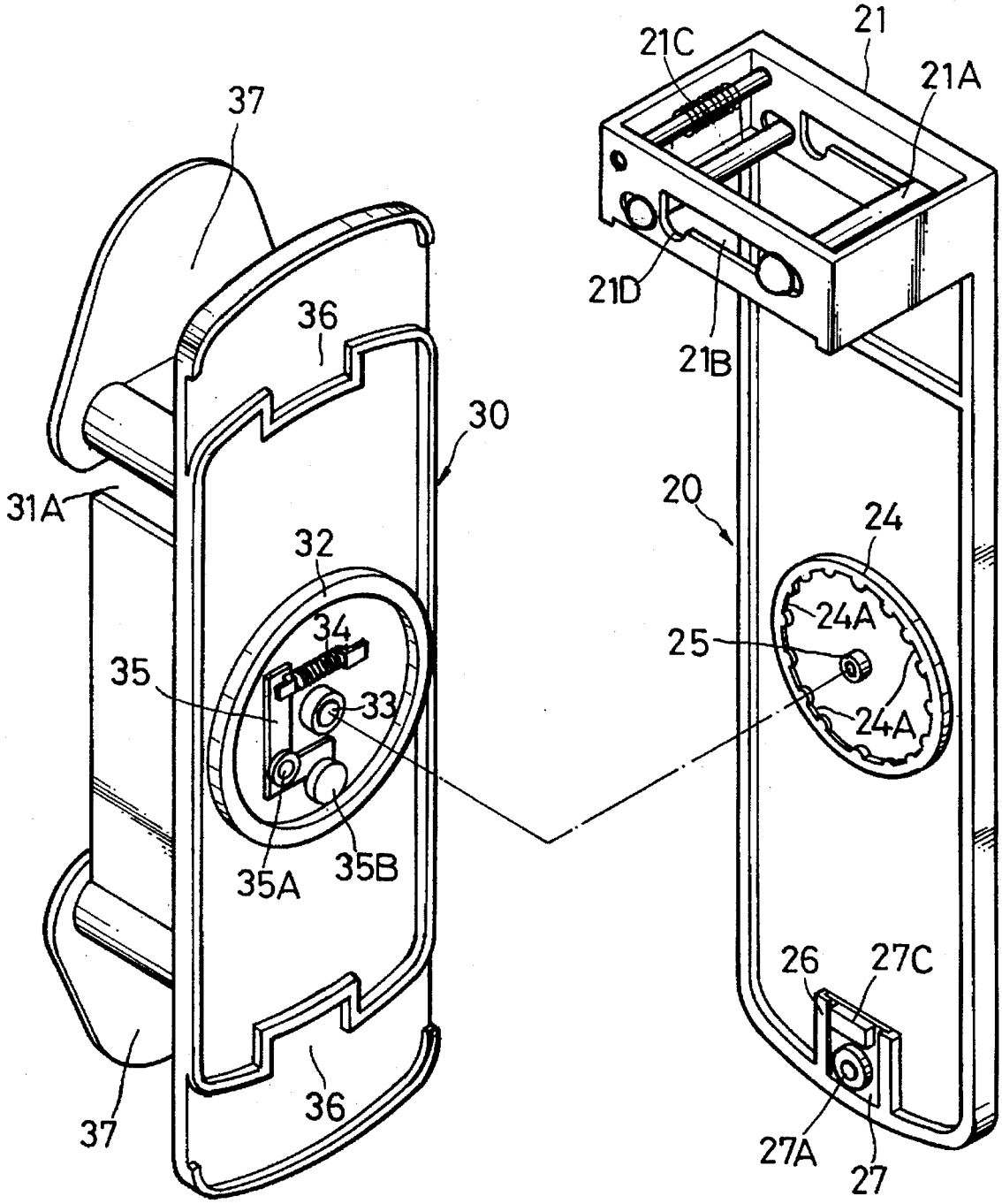
FIG. 3 is a breakdown view of fixed base and movable base of the present invention.
Figure 5:
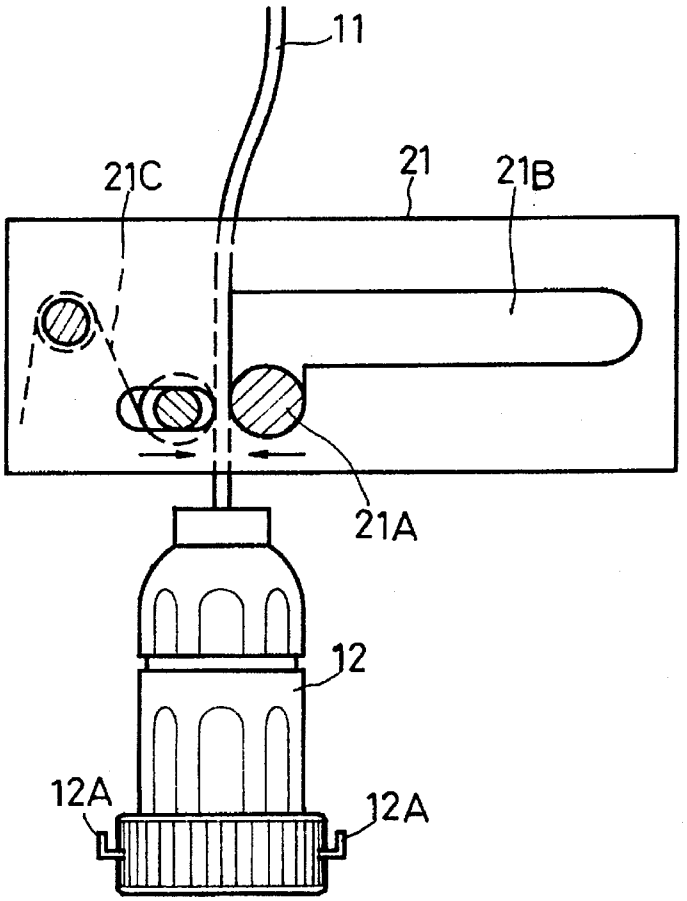
FIG. 5 is an optional view of the inlet connector having been nested in the holder according to the present invention.
Figure 4:
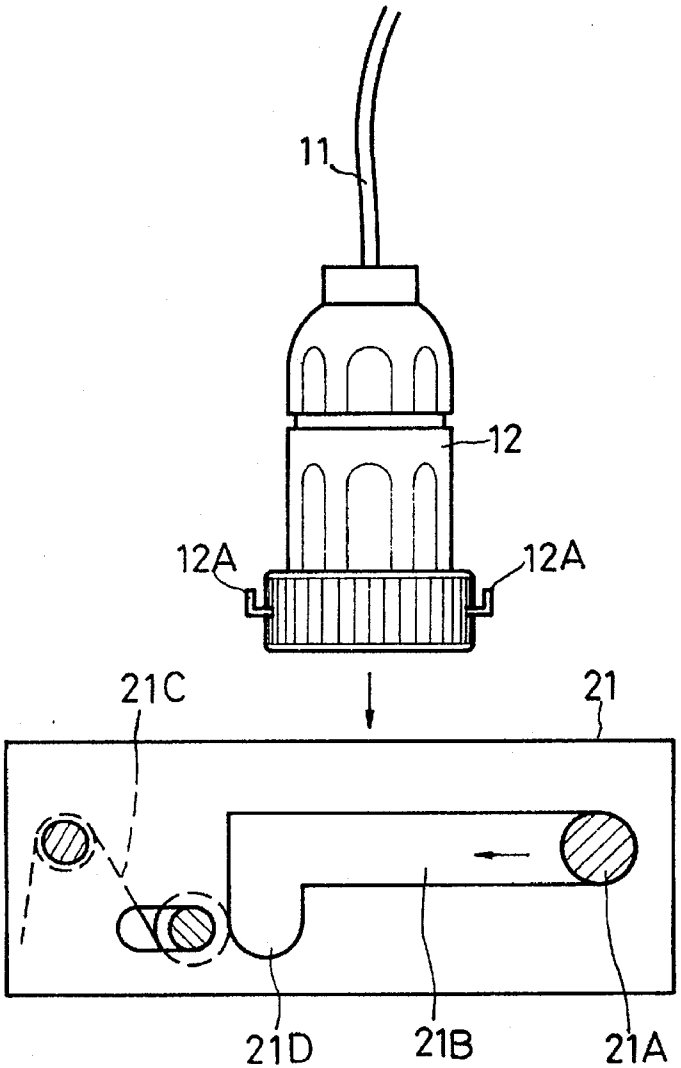
FIG. 4 is an optional view of the inlet connector having not been nested in the holder according to the present invention.

As shown in FIGS. 2, 3 and 4, a roller support holder (21) is provided at the top of the inner side plate of fixed base (20). A roller (21A) is provided in the holder (21) for movement in long slots (21B) on the two parallel side walls of the holder (21). When the inlet connector (12) and spray hose (11) are nested in the holder (21) as shown in FIG. 5, the roller (21A) can be moved to be caught in a clamping notch (21D) of each slot (21B) so as to bind the spray hose (11) in place; in addition, a second spring-biased roller 21C is mounted in two short slots on the walls of holder (21). Through the two-way binding action of roller (21A) and spring biased roller (21C), the spray hose (11) is elastically and firmly positioned in the holder (21). Residual water in the spray hose (11) can be squeezed out so as to increase the life of the spray hose (11).

Roller 21A can be moved out of notches 21D into long slots 21B to disengage the rollers from the hose.

Figure 8:
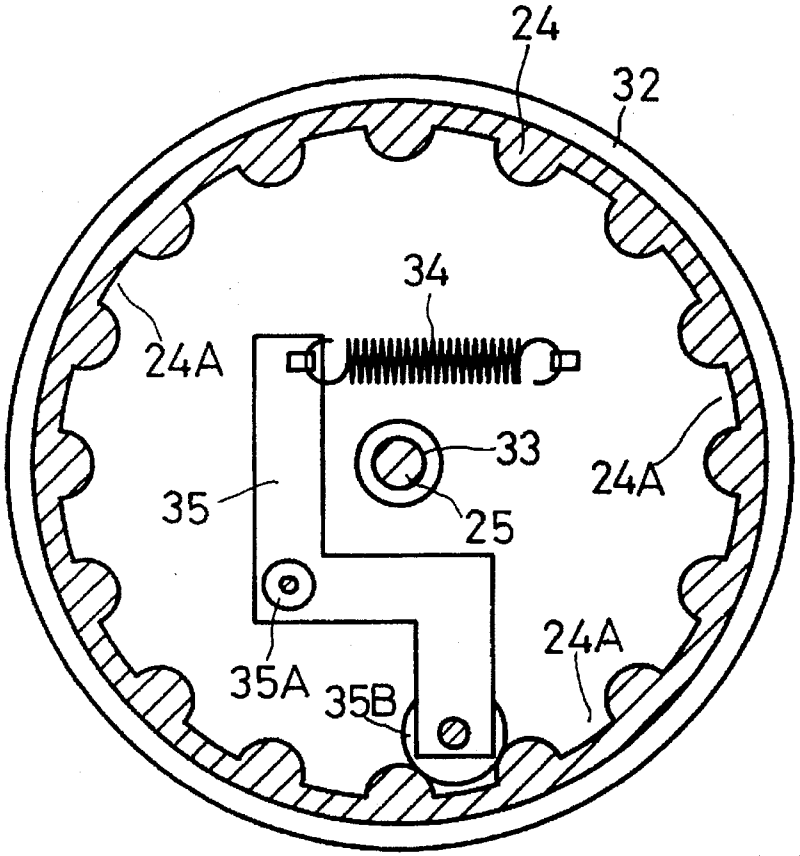
FIG. 8 is an optional view of the brake element caught in the corrugated chute in accordance with the present invention.

As shown in FIGS. 3 and 8, a disk (24) is provided at the center of the inner side plate of fixed base (20) and a plurality of corrugated chutes (24A) are provided along the inner edge of disk (24) in a continuous state; another disk (32) with a inner diameter larger than the outer diameter of the disk (24) is provided at the center on the inner side plate of movable base (20) corresponding to the position of disk (24), so that a sleeve bearing element (33) of movable base (30) is nested on a shaft bearing element (25) of the fixed base (20) to rotatably mount the movable base (30) on the fixed base (20). The disk (32) of movable base (30) can entirely cover the disk (24) of fixed base (20) and rotate around the outer edge of disk (24) thereof.

Figure 9:
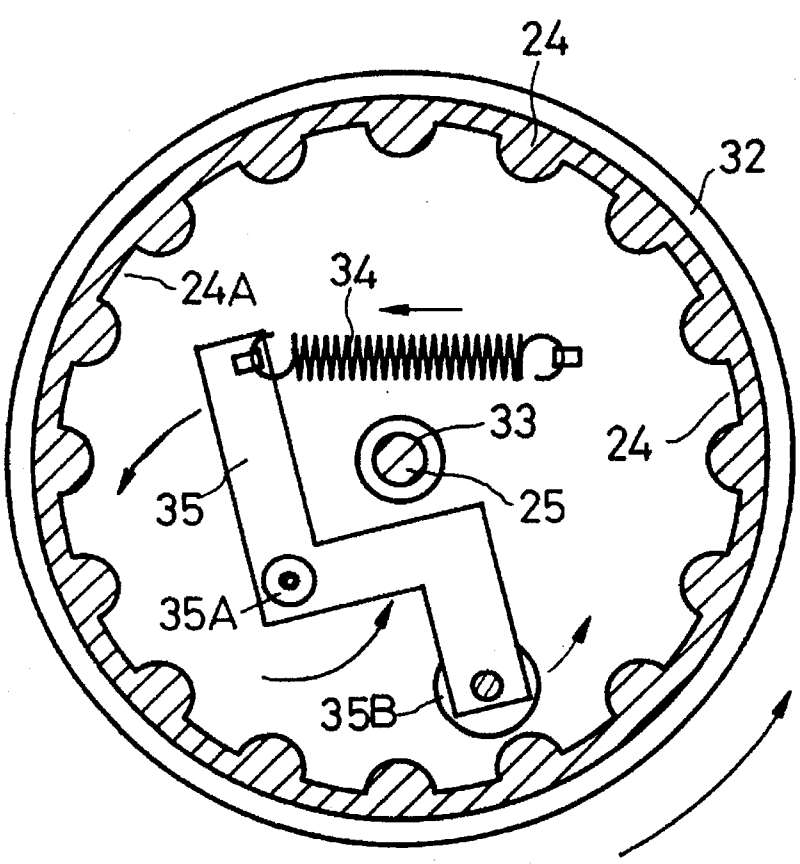
FIG. 9 is an optional view of brake element capable of moving in the corrugated chute in accordance with the present invention.

As shown in FIG. 8, a brake element (35) under the control of a spring (34) is provided in the disk (32) of movable base (30). One end of the spring (34) is fixed on the plate of movable base (30), and another end thereof is fixed at the end of brake element (35); since the brake element (35) is movably and pivotally provided on a support shaft (35A), when one stop (35B) at the front end of brake element (35) is entirely caught in the corrugated chutes (24A) on the disk (24) of fixed base (20), the spring (34) is in a contracted state without any tension (as shown in FIG. 8); but when the movable base (30) is rotated, the stop (35B) will move in and out along the corrugated chutes (24A) on the disk (24) (as shown in FIG. 9) to force the spring (34) to generate an action of stretching elastic force and actuate the brake element (35) to be caught intermittently in the continuous corrugated chutes (24A); so when the movable base (30) is rotated, an effect of continuous positioning, catching and stopping actions are generated between the movable base

(30) and the fixed base (20) but will never generate stall leading to difficult regulation and control when stretching or folding the spray hose (11).

Figure 7:
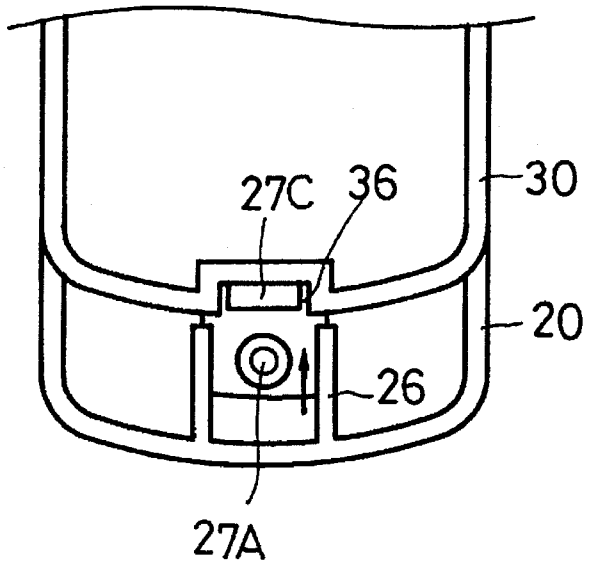
FIG. 7 is an optional view of fixed base having been assembled with movable base according to the present invention.
Figure 6:
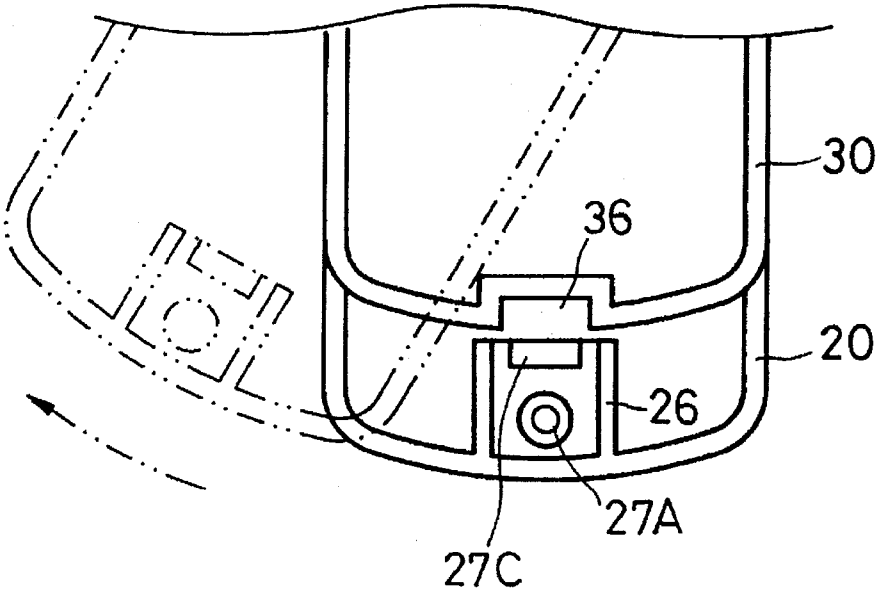
FIG. 6 is an optional view of fixed base having not been assembled with movable base according to the present invention.
Figure 10:
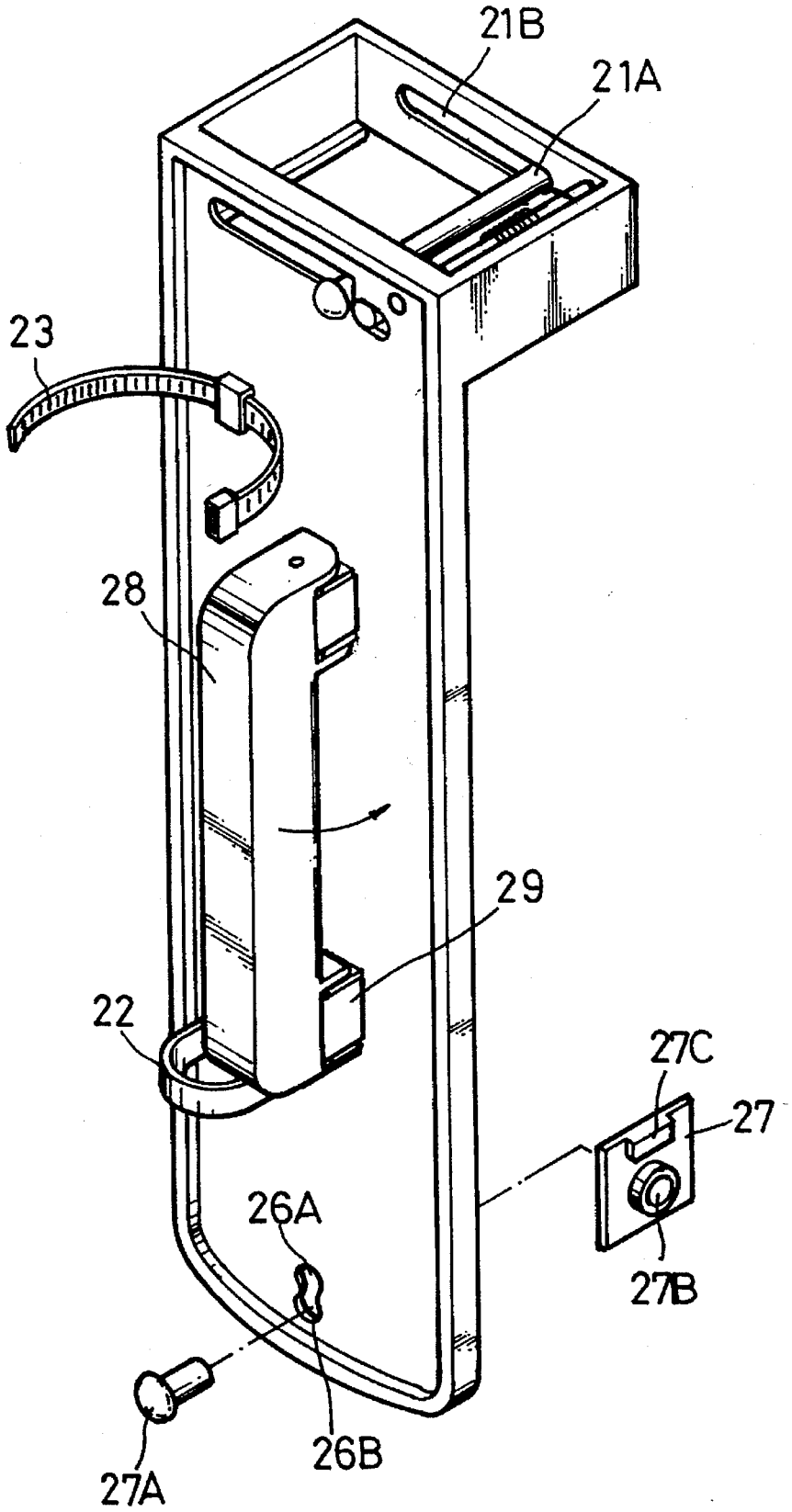
FIG. 10 is an appearance view of the outer side plate of fixed base of the present invention.

As shown in FIG. 3 and 10, a clamping groove (26) is provided at the bottom of inner side plate of the fixed base (20), and upper hole (26A) and lower hole (26B) are provided on the plate of clamping groove (26); in addition, a lock element (27) is provided to be inserted in the clamping groove (26), a button (27A) is first inserted in the upper hole (26A) or lower hole (26B) and then fixed in a fixing hole (27B) of lock element (27) together; so when the user operates and controls the button (27A) to act up or down, the lock element (27) also acts up or down as a linkage. A positioning block (27C) is provided at the top end of lock element (27) as shown in FIG. 3, 6 and 10, when the button (27A) is located in the position of lower hole (27B), the positioning block (27C) of lock element (27) has not been inserted in a fixing groove (36) on the inner side plate of movable base (30), so there is a free state without binding between the fixed base (20) and the movable base (30), the user can rotate the movable base (30) so as to proceed with the operation of rolling or releasing the spray hose (11). As shown in FIG. 7, when the button (27A) is located in the upper hole (26A), the positioning block (27C) of lock element (27) is inserted in the fixing groove (36) on the movable base (30) to form a fixed state between the fixed base (20) and the movable base (30).

Figure 12:
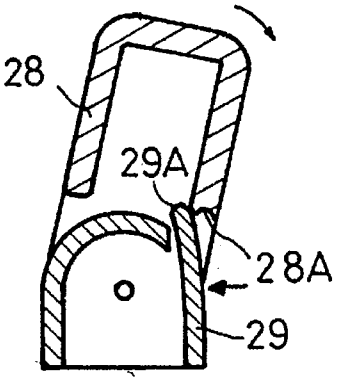
FIGS. 11–13 show the continuous actions of handle from upstanding state to folding state.
Figure 13:
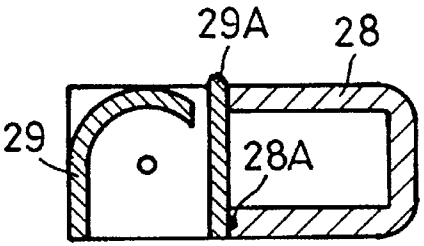
Figure 11:
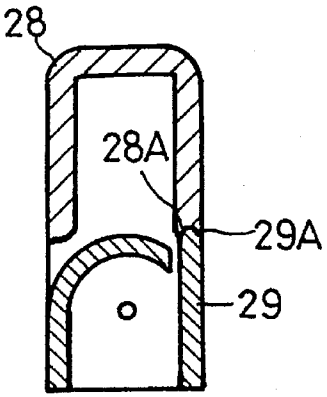

As shown in FIG. 10, the outer side plate of fixed base (20) is provided with a handle (28) having two ends movably and pivotally mounted on the protruding shaft seats (29) of fixed base (20). As shown in FIG. 11, a V-shaped groove (28A) is provided on a mounting arm at each end of handle (28); an inflective tangent plane (29A) is formed correspondingly on a manually deflectable detent wall of each shaft seat (29). When the handle (28) is upstanding, each V-shaped groove (28A) of handle (28) can be exactly caught in the inflective tangent plane (29A) of shaft seats (29) without disengagement therefrom; and when the handle (28) is in a horizontal state as shown in FIG. 12, the user can use his finger to apply a force to the detent wall of shaft seat (29) for bending with a small radian so that the V-shaped groove (28A) of handle (28) disengages from the exterior of inflective tangent plane (29A) of shaft seat (29). The handle (28) is in a free and movable state and can be horizontally folded on the fixed base (20) as shown in FIG. 13.

Figure 14:
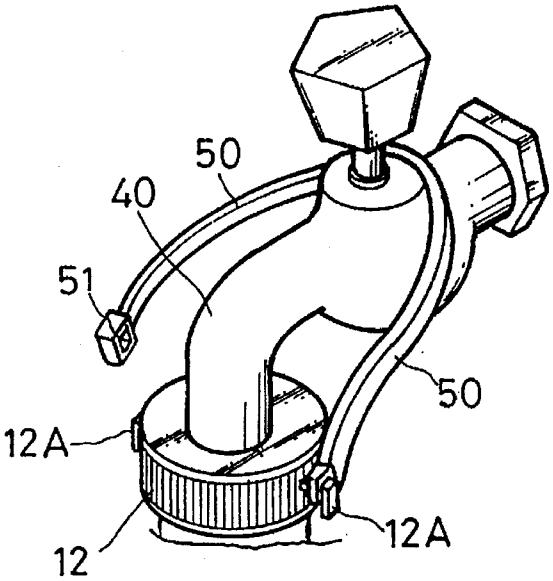
FIG. 14 is an optional view of the inlet connector hanged on the faucet with a hasp belt according to the present invention.

As shown in FIGS. 1, 4 and 14, the inlet end of inlet connector (12) is provided with two hook ears (12A). When the inlet connector (12) is nested on a faucet (40), a soft plastic hasp belt (50) can be hung on the faucet (40) through hooking two hook rings (51) at the two ends of hasp belt (50) on the two hook ears (12A) on the inlet connector (12) which can be stably fixed on the faucet (40) without coming off therefrom.

In summary, the structure of the present invention is novel and practical and able to improve the defect of inconveniently folding the conventional spray hose.

I claim:

1. A water hose-reel system comprising:

first relatively fixed flat base (20) having a first centrally located rotary bearing element (25), a first handle (28), and a roller-support holder (21) spaced radially from said bearing element;

said roller support holder (21) comprising two parallel roller-support walls, each roller-support wall having a relatively short slot, a relatively long slot, and a notch at one end of the long slot;

a first roller mounted in the short slots, a second roller mounted in said notches but capable of movement into the long slots, and spring means biasing said first roller toward said second roller;

a rotary hose-support means comprising a second flat base (30) positioned flatwise against said first base, said second flat base having a second centrally located bearing element (33) rotatable on said first bearing element, whereby said hose-support means can be rotated around a central rotational axis defined by said bearing elements;

said hose-support means comprising a compartment means (31) extending from said second flat base, and a second handle (38) mounted on said compartment means remote from the central rotational axis; and a flexible hose (11) foldable into a flattened substantially closed cross section on said hose-support means; said hose having a first water inlet end located in said compartment means, and a second water discharge end located outwardly beyond said rollers; said hose extending in spiral fashion around said compartment means and then through the space between said rollers;

said rollers exerting a squeezing force on the flattened hose as a result of the force applied to the first roller by said spring means; said second roller being manually movable into the long slots to widen the roller spacing for disengaging said rollers from the hose.

2. The hose-reel system of claim 1, and further comprising a spring-operated retarding mechanism located between said first base and said second base for limiting the rotational speed of said rotary hose-support means.

3. The hose-reel system of claim 1, and further comprising means for pivotably supporting said first handle (28) on said relatively fixed flat base, said pivotable support means comprising two hollow upstanding shaft seats (29) containing aligned pivot shafts, and spaced mounting arms extending from said handle alongside said shaft seats for rotary connection with said pivot shafts; each shaft seat comprising a manually deflectable detent wall; said handle having a groove (28A) normally engaged with each detent wall for holding the handle in an operating positioned;

said detent walls being manually deflectable for disengagement from the associated grooves, whereby the handle can be folded to an inactive position against said fixed base.

4. The hose-reel system of claim 1, and further comprising a slidable latch means (27) on said second flat base for locking said first and second bases against relative rotary movement.

* * * * *